US005823030A

United States Patent [19]

Theriault et al.

[11] Patent Number: 5,823,030

[45] **Date of Patent: *Oct. 20, 1998**

[54] CYLINDER LOCK SYSTEM

[75] Inventors: Kenneth T. Theriault, Meriden; Charles W. Eden, Jr., Plantsville, both of Conn.

[73] Assignee: International Security Products, Inc., Southington, Conn.

[ * ] Notice: The term of this patent shall not extend beyond the expiration date of Pat. No. 5,819,567.

[21] Appl. No.: 791,756

[22] Filed: Jan. 29, 1997

[51] Int. Cl.[6] ..... F05B 15/00

[52] U.S. Cl. ..... 70/419; 70/389; 70/390; 70/406

[58] Field of Search ..... 70/326, 358, 389, 70/419, 390, 375, 406–409

[56] References Cited

U.S. PATENT DOCUMENTS

| | | | |
|---|---|---|---|
| 915,317 | 3/1909 | Thomas . | |
| 2,151,245 | 3/1939 | Swilens . | |
| 3,035,433 | 5/1962 | Testa . | |
| 3,531,959 | 10/1970 | Weber . | |
| 3,742,744 | 7/1973 | Lumme | 70/358 |
| 4,085,601 | 4/1978 | Sauder | 70/364 R |
| 4,222,252 | 9/1980 | Tietz . | |
| 4,325,242 | 4/1982 | Tietz | 70/358 |
| 4,377,082 | 3/1983 | Wolter | 70/364 R |
| 4,377,940 | 3/1983 | Hucknall | 70/364 R |
| 4,393,673 | 7/1983 | Widén | 70/358 |
| 4,608,842 | 9/1986 | Tietz | 70/358 |
| 4,612,787 | 9/1986 | Prunbauer et al. | 70/358 |
| 4,638,651 | 1/1987 | Surko, Jr. . | |
| 4,787,225 | 11/1988 | Häuser et al. | 70/401 |
| 4,869,085 | 9/1989 | Meissner | 70/409 |
| 5,493,884 | 2/1996 | Hinz et al. . | |

FOREIGN PATENT DOCUMENTS

| | | | |
|---|---|---|---|
| 2931653 | 2/1981 | Germany | 70/358 |
| 4035934 | 9/1991 | Germany | 70/358 |

*Primary Examiner*—Steven N. Meyers
*Assistant Examiner*—Tuyet-Phuong Pham
*Attorney, Agent, or Firm*—Alix, Yale & Ristas, LLP

[57] ABSTRACT

A key having profile features which include a shaped indentation on a first side of the blade and an aligned projection on the opposite side of the blade cooperates with a cylinder lock with unauthorized key trapping capability. The lock has an auxiliary locking pin which cooperates with the key indentation and a movable plate member which cooperates with the key projection. Both the indentation and projection must be present and properly sized and shaped for a properly bitted key to operate the lock.

14 Claims, 6 Drawing Sheets

CYLINDER LOCK SYSTEM

BACKGROUND OF THE INVENTION (1) Field of the Invention

The present invention relates to increasing the security afforded by mechanical locks and, particularly, to minimizing the possibility of the availability of key blanks which may be cut to form unauthorized keys for such locks. More specifically, this invention is directed to an improved cylinder lock and a novel key which, in cooperation, define a lock system which provides highly secure access control. Accordingly, the general objects of the present invention are to provide novel and improved methods and apparatus of said character.

(2) Description of the Prior Art

Mechanical locks which employ one or more pin tumbler arrays are well known in the art. In such prior locks, the pin tumblers are arranged in "stacks" which are radially displaceable with respect to the axis of rotation of a plug or core, such displacement occurring in response to insertion of a key in a keyway defined by the core. The pin tumbler stacks comprise at least an upper or driver pin and an abutting, axially aligned driven or bottom pin, the pins being disposed in pin chambers provided in both the core and the surrounding shell of the lock. The pin tumbler stacks are resiliently biased in the direction of the axis of core rotation and, when there is no key in the keyway, one pin of each stack bridges the gap between the core and shell thus preventing relative rotation therebetween. As a result of communication between the keyway and the pin chambers in the core which receive the bottom pins, insertion of a properly bitted key in the keyway will result in pin tumbler stack displacement which typically places the interface between the driver and bottom pins at a shear line defined by the core outer circumference. Thus, a properly bitted key will permit the core, with the bottom pins, to rotate within the shell while the driver pins remain stationary. Core rotation will, through the action of a cam or tailpiece mechanically coupled thereto, activate a locking mechanism or latch.

Locks of the type described briefly above are known in the art as "cylinder" locks. The most common manner of defeating a cylinder lock consists of "manufacture" of an unauthorized key. It is not possible to ensure against the defeat of a cylinder lock by providing such a lock with a keyway having a complex, i.e., very intricate, profile and/or through the use of various arrangements of pin tumbler stacks. The foregoing inability is, in part, a function of the fact that various manufacturers will provide key blanks having blades which, either as manufactured or as shaped using conventional key-cutting machines, have a profile which will enable their use, after being "cut", with locks which are sold in volume. Thus, there has been a long standing desire for a lock system which affords increased security through minimizing the possibility of unauthorized manufacture of replacement key blanks and, particularly, for a lock system which affords the lock manufacturer the ability to exercise key control by means of being the sole source of the key portion of the system. In addition, a high level of security also dictates that a lock "trap" unauthorized keys and, especially, partly formed keys which are being "patterned" in an attempt to defeat the lock.

SUMMARY OF THE INVENTION

The present invention overcomes the above-briefly discussed and other deficiencies and disadvantages of the prior art and, in so doing, provides a novel lock system characterized by a key which, in part, has a unique profile. A lock system in accordance with the present invention also encompasses a novel and improved cylinder lock having elements which cooperate with the aforementioned unique key profile to enable the relative rotation of the core and, under certain circumstances, to also mechanically capture unauthorized keys in the keyway.

A lock system in accordance with the invention includes a cylinder lock with a core which, at the longitudinal position of at least one pin tumbler stack, is provided with a cut-out generally in the shape of a circular segment. With the lock in the locked state, i.e., prior to rotation of the core relative to the shell, this cut-out will be out of alignment with the pin tumbler stack. The cut-out is in communication with the keyway via an opening provided in a first side thereof. A plate member or segment is located in the cut-out, the plate member being sized and shaped so as to be capable of limited movement within the cut-out relative to the core, such movement being guided by the internal diameter of the shell. Movement of the plate member may be produced by a suitably shaped and located camming projection, provided on a first side of an authorized key, which extends through the opening in the keyway first side. This camming projection extends outwardly beyond the plane of the side of the blank from which the key was formed and into the segment-shaped cut-out. The plate member, when caused to move along a path defined by the shell internal diameter in response to contact with a camming projection on an authorized key, will function as an extension of the core and will present an edge which generally corresponds to the shear line. Thus, with an authorized key in the keyway, the core will appear to be uninterrupted to the driver pin of a pin tumbler stack at the location of the cut-out and the core may thus rotate past the point of registration of the driver pin and plate member without driver pin radial motion. However, in the case of an unauthorized key, i.e., a key which lacks the camming projection, core rotation will cause the outer periphery of the plate member to be displaced below the shear line and, in part, to define an opening into which the driver pin will move once the core has been rotated relative to the shell sufficiently to fully register the pin tumbler chamber in the shell with the cut-out in the core. The driver pin will, accordingly, move radially toward the axis of core rotation so as to bridge the shear line and prevent further core rotation in either the clockwise or counterclockwise direction. The lock will thus be rendered inoperable and the unauthorized key will be trapped in the keyway.

A lock system in accordance with the invention also includes a suitably shaped and located indentation in the opposite side of the key blade with respect to the camming projection. This indentation is in alignment with and formed simultaneously with the oppositely disposed camming projection. The indentation is in registration with a chamber in the core which receives an auxiliary locking pin. This chamber is, most expediently, oriented such that its axis is transverse to a plane defined by the side of a blank from which the key was formed. The auxiliary locking pin is resiliently biased outwardly whereby a first end thereof engages a cooperating recess in the inner diameter of the shell, i.e., the auxiliary locking pin bridges the shear line with the lock in the locked state. The outwardly disposed end of the auxiliary locking pin and the side wall of the cooperating recess in the shell are shaped such that relative rotation between the core and the shell will, if movement of the auxiliary locking pin against its spring bias is possible, cam the auxiliary locking pin out of the recess in the shell, the outer end of the locking pin sliding on the internal diameter of the shell during further core rotation. However, this camming action can occur only when a key blade having an indentation sized, shaped and located to receive the second end of the auxiliary locking pin is present in the keyway. Thus, an authorized key for a lock system in accordance with the invention must have both a uniquely shaped and positioned camming projection on a first side thereof and a properly positioned and shaped locking pin receiving indentation on the opposite second side thereof.

BRIEF DESCRIPTION OF THE DRAWING

The present invention may be better understood, and its numerous objects and advantages will become apparent to those skilled in the art, by reference to the accompanying drawing wherein like reference numerals refer to like elements in the several Figures and in which.

DESCRIPTION OF THE DISCLOSED EMBODIMENT

Figure 1:
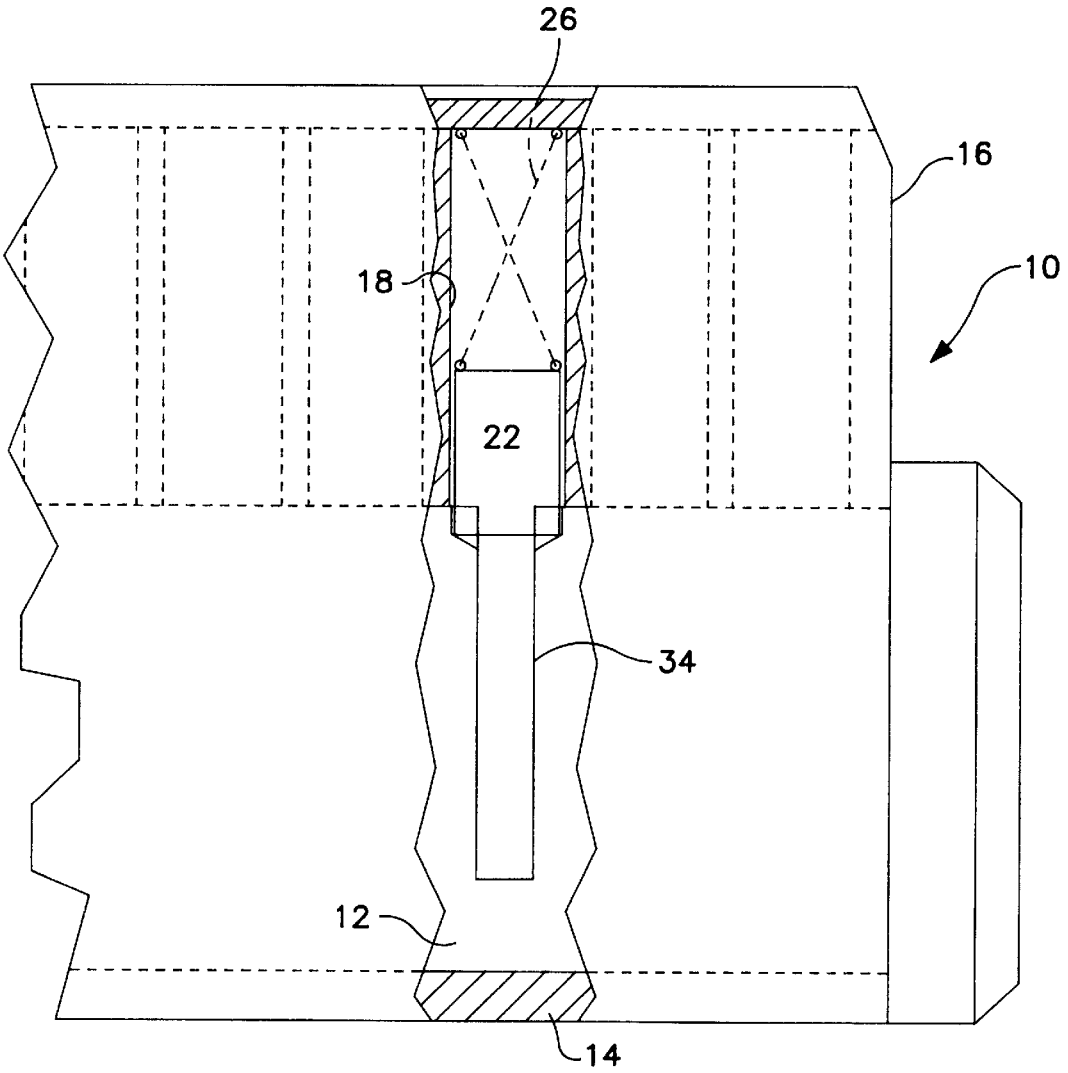
FIG. 1 is a partial side elevation view, partly broken away to show detail, of a cylinder lock in accordance with a preferred embodiment of the present invention.

With reference to the drawings, a cylinder lock in accordance with the present invention is indicated generally at 10. Lock 10, as is conventional, comprises a core 12 which may be rotated, about an axis of rotation, relative to a shell 14. In the disclosed embodiment, shell 14 includes an extension or bible 16. A single linear array of pin chambers, such as chamber 18, are provided in bible 16. The pin chambers 18, with the lock in the locked state, are in axial registration with pin chambers 20 in core 12. Pin tumbler stacks, which in the disclosed embodiment comprise an upper or driver pin 22 and a driven or bottom pin 24, are provided in the registered pin chambers. The pin tumbler stacks are resiliently biased radially in the direction of the axis of rotation of core 12. In the disclosed embodiment the biasing is accomplished by means of compression springs, such as the spring indicated schematically at 26, which contact the outwardly disposed ends of the driver pins. A tailpiece or cam, not shown, will be connected to the end of core 12 disposed oppositely to the end which defines the entrance to the keyway. The tailpiece will be coupled to a latch mechanism or the like so that the lock may be employed to selectively prevent and permit access to a space on one side of a door in which the lock is installed.

The lock as described above is of conventional construction. It will thus be understood by those skilled in the art that the configuration and location of the pin chambers and pin tumbler stacks may be varied without departing from the invention. For example, there may be multiple arrays of pin chambers, angularly offset from one another, and the pin tumbler stacks may include any number of pins.

Figure 6:
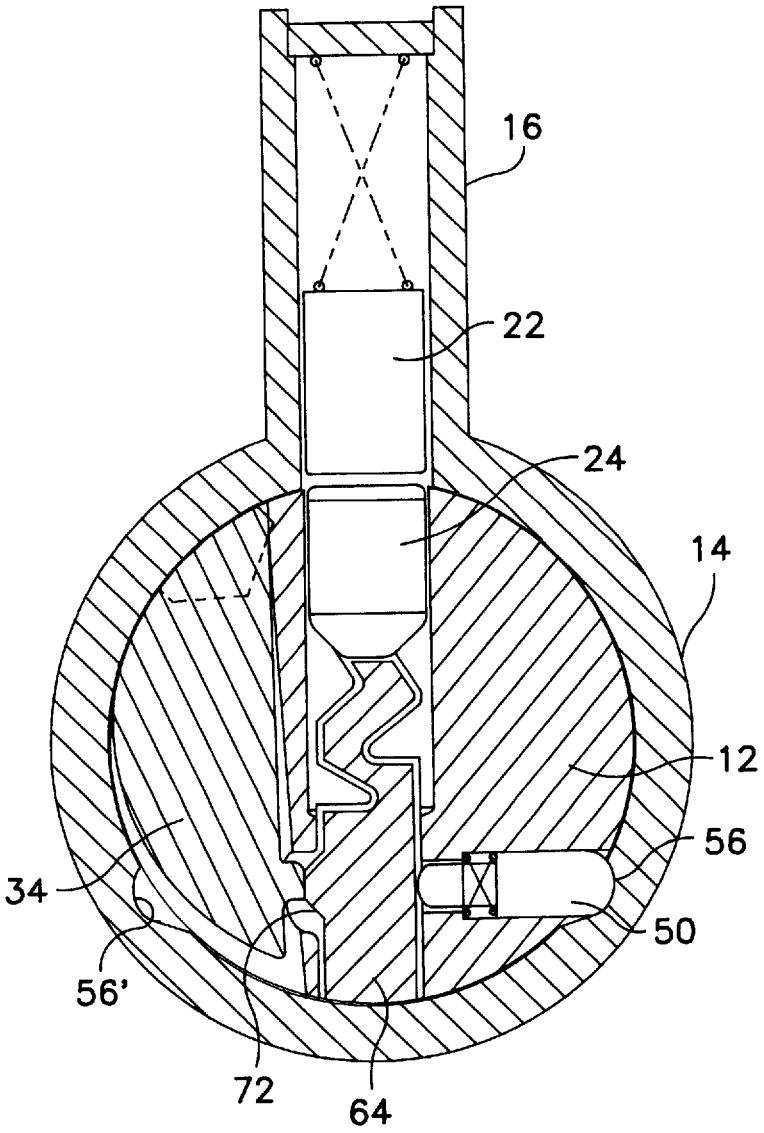
FIG. 6 is a view similar to FIG. 4 which represents an attempt to defeat a lock in accordance with the present invention employing a key having only one of the blade features of the invention.

Also in accordance with conventional construction, and as may be seen from FIGS. 4, 6 and 7, a keyway 28 is provided in core 12. The keyway is in communication with the inwardly disposed ends of the pin chambers 20 in the core and has a profile, i.e., a cross-sectional area, chosen by the lock manufacturer. A conventional keyway includes a plurality of wards which, in part, define the keyway cross-section. A correct key, i.e., a key which may be inserted in the keyway, must have a blade with side surfaces milled so as to be complementary with these wards. Thus, starting from a key blank with parallel sides, longitudinal cuts may be made so that the blade cross-section matches the keyway cross-section. Additionally, in order to operate the lock, the key blade must be further "cut", i.e., bitted, to have surface irregularities which match the combination of the lock as determined by the location of the pin tumbler stacks and the relative lengths of the individual pins forming the stacks. In the least complicated arrangement, as shown in the drawings, the key will be bitted by removing material from the upper edge of the blade to produce the customary serrated edge. The "combination" of a conventional prior art cylinder lock is thus defined by the key blade profile and bitting. Insertion of a properly bitted key into the keyway will establish contact between the irregular upper edge of the key blade and the bottom pins and, as depicted in FIGS. 4, 6 and 7, will result in movement of the pin tumbler stacks against the bias of springs 26 so as to place the interface between the driver and bottom pin of each pin tumbler stack at the shear line between the core 12 and shell 14. When all of the pin tumbler stacks have been repositioned from the locked state, i.e., the state where one pin of each stack bridges the shear line and thus is partly located in a pin tumbler chamber of both the core and shell, rotation of the core relative to the shell is permitted. To summarize, in a conventional cylinder lock, in order to permit relative rotation between the core and shell, the key blank must be provided with longitudinal cuts on the sides to define a profile which matches the keyway cross-section and must be cut to provide surface irregularities commensurate with the lock combination defined by the pin tumbler stacks.

In accordance with the present invention, at the location of at least one of the pin tumbler stacks, a circular segment is cut from core 12. This segment is defined by a wall 30 which, with the exceptions to be discussed below, is straight and continuous between two points of intersection with the shear line. In the disclosed embodiment, the spacing between keyway 28 and wall 30 increases from a first end of the wall, located adjacent the bottom of the keyway, to an opposite end of wall 30 which is adjacent to the outer end of a pin chamber 20. Thus, wall 30 defines a ramp. An opening 32 in wall 30 provides communication between the keyway and the space formed by the circular segment cut-out. In the disclosed embodiment, opening 32 is located at the base of a slot which defines a portion of the keyway profile. As disclosed, and it will be understood that other arrangements are possible, opening 32 is defined by a groove having a maximum depth which exceeds the thickness of the wall separating the circular segment cut-out from the keyway.

A movable plate member 34 having a shape which is similar to, but different from, the circular segment cut-out defined by wall 30 is inserted in the cut-out. Plate 34 has a first, straight side 36 which faces wall 30. In the disclosed embodiment, side 36 is provided with a projection 38 which extends into opening 32. Plate 34 also has a first arcuate side 40 which extends from a first end of side 36, the radius of side 40 being substantially the same as the radius of core 12. Arcuate side 40 terminates at, i.e., merges with, a second side surface 42 which may also be arcuate, as shown, or straight. Side surface 42 extends to the second end of straight side 36, i.e., the end of side 36 which is disposed above the plane of the top of the keyway. The width of plate 34 is, as may best be seen from FIG. 1, less than the diameter of the pin chamber 18 in bible 16.

Core 12 is provided with a blind hole 44 which, in part, extends into the segment cut-out which, in part, is defined by wall 30. Hole 44 has a size and shape complementary to the lower end of a driver pin 22. The axis of hole 44 intersects the circular segment cut-out. Consequently, plate 34 extends into, and may effectively bridge, blind hole 44. Depending upon the position of plate 34, access of pin 22 to hole 44 will either be permitted or blocked. The position of plate 34 is controlled in the manner to be described below.

A cylinder lock in accordance with the invention also comprises at least a first auxiliary locking pin 50. Pin 50 has an axis and is disposed, for reciprocal movement, in a pin chamber 52 provided in core 12. Chamber 52 communicates, at a first end, with keyway 28 and, at its opposite end, with the circumference of core 12. Chamber 52 has an axis which, in the disclosed embodiment, is oriented transversely with respect to a plane A—A defined by the axes of the pin tumbler stacks, plane A—A thus also being a plane defined by the keyway. Chamber 52 has two portions of different internal diameter and thus defines a shoulder against which the first end of a biasing spring 54 is seated. The opposite end of biasing spring 54 contacts a shoulder on pin 50, defined by the junction of two different diameter portions of the auxiliary locking pin, and thus urges pin 50 in the direction of shell 14. Shell 14 is provided with a recess 56 which receives the end of auxiliary locking pin 50 disposed outwardly with respect to the keyway. With the cylinder lock in the locked state, the outwardly disposed end of auxiliary locking pin 50 will be disposed in recess 56 as, for example, shown in FIG. 6, i.e., auxiliary locking pin 50 will extend across the shear line. Accordingly, auxiliary locking pin 50 will cooperate with the pin tumbler stacks to prevent rotation of core 12 when an authorized and properly bitted key is not present in keyway 28. The opposite, inwardly disposed end of auxiliary locking pin 50 will normally, i.e., when the lock is in the locked state, be substantially flush with the side of keyway 28.

In the disclosed embodiment of a lock in accordance with the invention, the outwardly disposed end of auxiliary locking pin 50 and a portion of the wall which defines recess 56, i.e., the wall portion 58 which extends from the maximum depth of the recess in the direction of core rotation to the inner diameter of shell 14, cooperate respectively in the manner of cam follower and cam surface. Thus, when rotation of core 12 relative to shell 14 is enabled in the manner to be described below, rotational force imparted to core 12 will cause the cam follower outer end of auxiliary locking pin 50 to ride over the cooperating cam surface 58 of recess 56 and the resulting camming action will drive the auxiliary locking pin 50 axially inwardly toward the keyway. Such axially inward motion, obviously, can occur only if a space having a size, shape and location adapted to accept the inner end of pin 50 is present.

Figure 2:
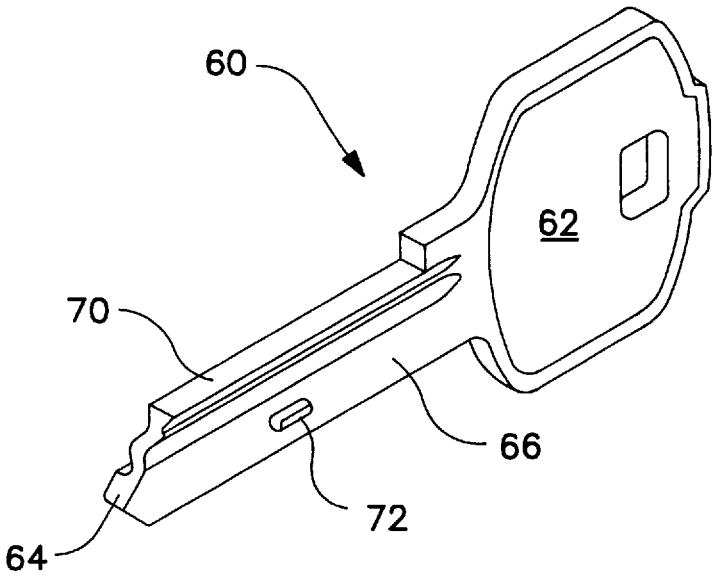
FIGS. 2 and 3 are perspective views, taken from opposite sides, of a key of a lock system in accordance with the invention.
Figure 3:
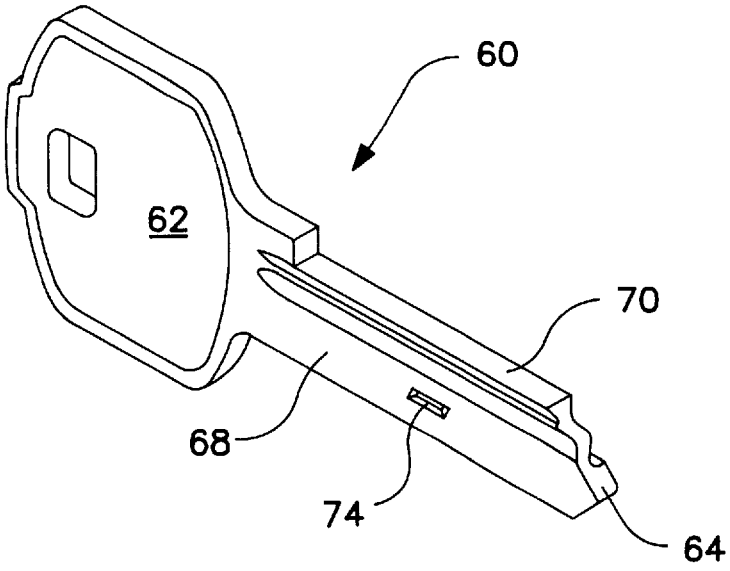

A key blank in accordance with the invention is indicated generally at 60 in FIGS. 2 and 3. Key blank 60 includes a bow portion 62 and a blade portion 64, part of the blade portion being shown on an enlarged scale in FIG. 5. As is conventional, key blank 60 has a pair of oppositely disposed planar sides 66, 68, a top edge 70 and an oppositely disposed bottom edge. In the embodiment of the invention being described, wherein a single array of pin tumbler stacks defines the conventional portion of the combination for operating the lock, top edge 70 of blade 64 will be cut to an irregular shape to define the bitting. As key blank 60 is shown, the key profile commensurate with the keyway cross-section has, also in the conventional manner, been produced by milling the sides 66 and 68, i.e., by removing material from the planar side surfaces of the blank. Such milling will customarily be performed by the lock manufacturer or, in the case of suppliers of "replacement" keys, by the key blank manufacturer. Locksmiths also often have machinery for cutting planar sided key blanks to achieve the requisite profile.

Key blank 60 is differentiated from the prior art by the provision, on a first side thereof, of a camming projection 72. Also, on the second opposite side, a key blank in accordance with the present invention is provided with an indentation 74. The preferred method of production of the camming projection and indentation is a stamping operation performed from the side of the key blade which has indentation 74.

Figure 4B:
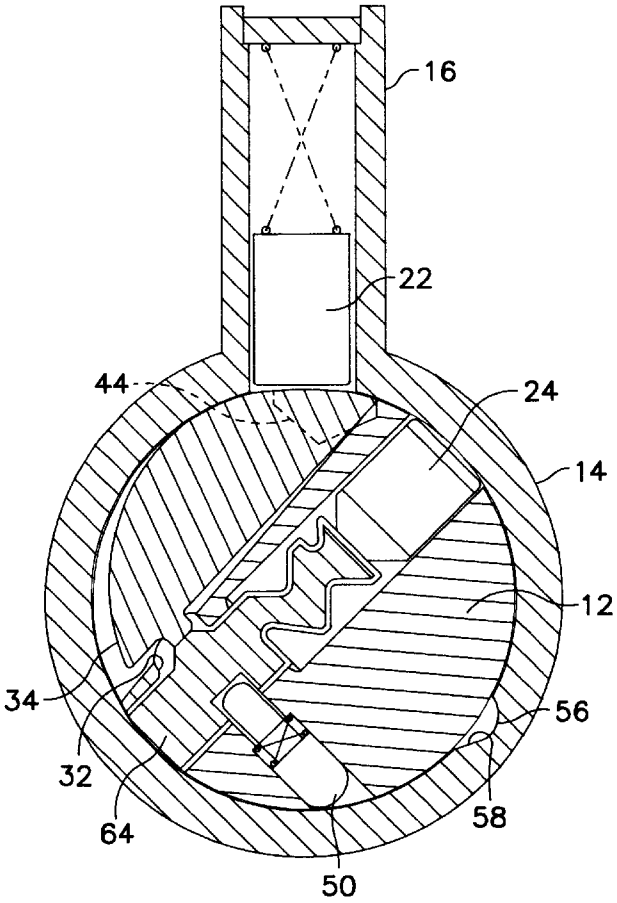
FIGS. 4*a* and 4*b* are cross-sectional, side-elevation views of a lock system in accordance with the present invention at different stages of operation, FIGS. 4*a* and 4*b* being views taken transversely with respect to FIG. 1 and depicting the lock of FIG. 1 in combination with the key of FIGS. 2 and 3.
Figure 4A:
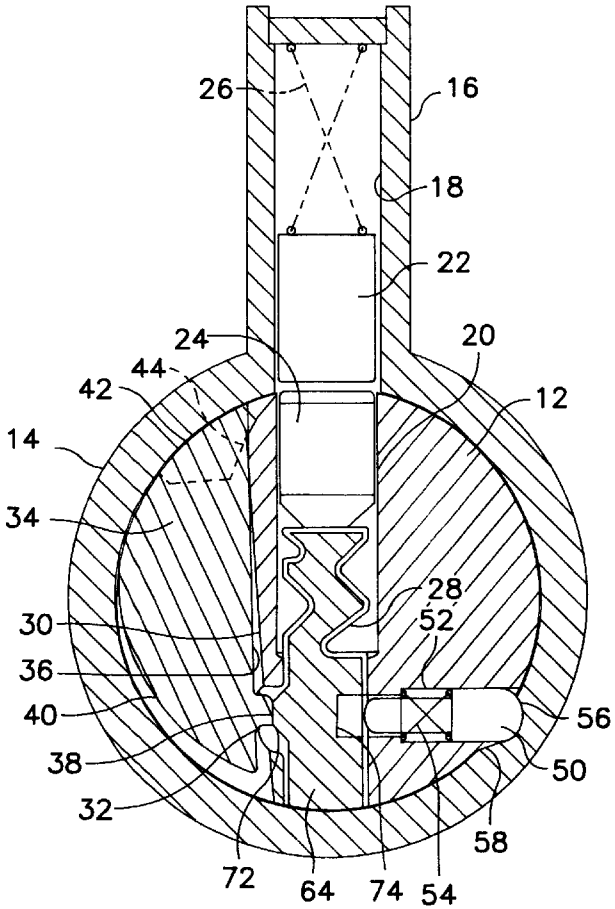
Figure 5B:
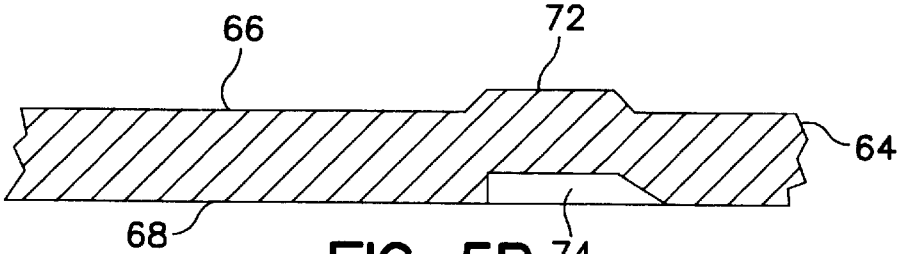
FIGS. 5*a*–5*c* are partial views of the blade of the key of FIGS. 2 and 3.
Figure 5A:
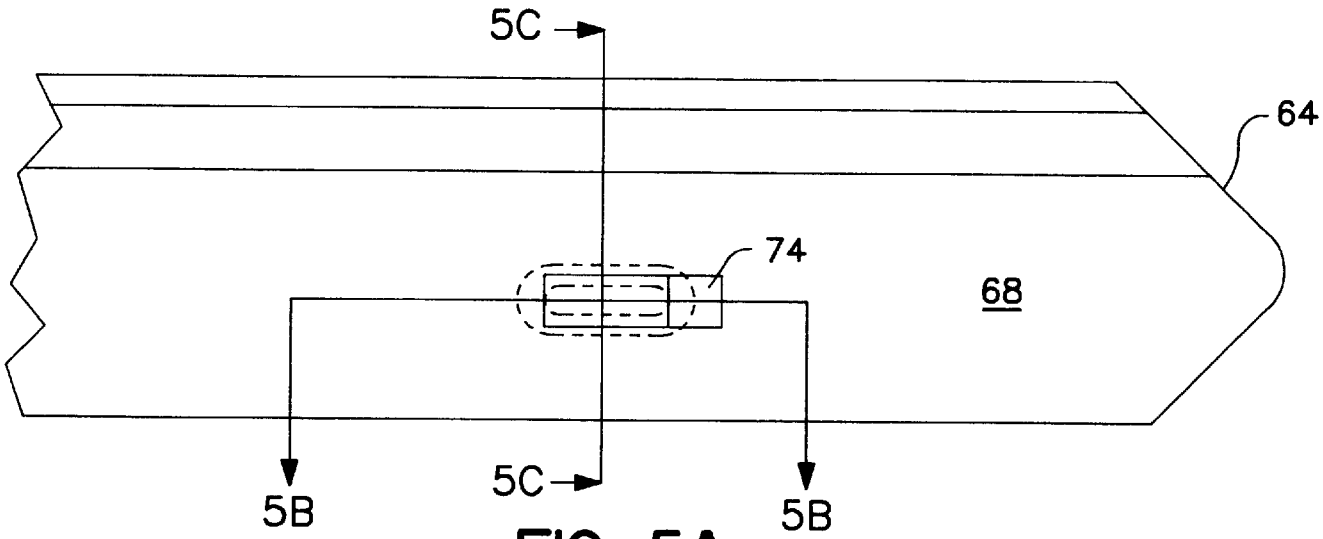
Figure 5C:
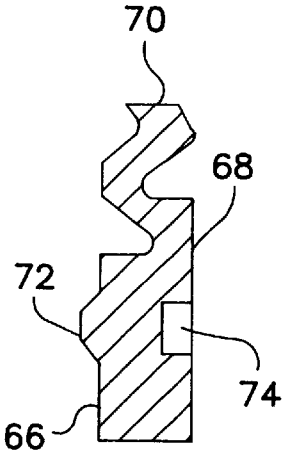

FIGS. 4A and 4B depict the operation of a lock in accordance with the present invention with a correct, i.e., an authorized, key formed from the key blank 60 of FIGS. 2 and 3. The insertion of such a correct key in keyway 28 will result in the establishment of contact between camming projection 72 on the key blade and projection 38 on plate member 34. Referring to FIG. 5B, it may be seen that the leading edge of projection 72 ramps upwardly to the top of the projection. Contact between projections 72 and 38 will impart clockwise movement relative to core 12 of plate member 34. This movement will be guided by the inner diameter of shell 14 and thus plate member 34 will be driven upwardly such that the junction of side 36 and surface 42 is in an abutting relationship with the upper end of wall 30. This abutting relationship causes side surface 42 of the plate member to bridge blind hole 44. Accordingly, core 12 may be rotated within shell 12 and, during such rotation, side 42 of plate 34 will initially prevent driver pin 22 from entering blind hole 44, as depicted in FIG. 4B. As rotation of the core continues, the arcuate side 40 of plate 34 will contact the bottom of driver pin 44 and urge the driver pin against the bias of spring 26 so that rotation of the core to the unlocked position may be accomplished.

Simultaneously with the operation described immediately above, cooperation between cam surface 58 and the cam follower end of auxiliary locking pin 50 will, as also depicted in FIG. 4B result in the auxiliary locking pin being driven inwardly, such motion being permitted by the presence of the indentation 74 of the key blade in registration with pin chamber 52. During rotation of the core to the unlocked position of the lock, the cam follower end of auxiliary locking pin 50 will slide on the inner diameter of shell 14.

Referring to FIG. 6, an attempt to operate the lock of the present invention with a properly bitted key having camming projection 72 but lacking indentation 74 will be unsuccessful because, as is readily apparent from the drawing, the auxiliary locking pin 50 cannot be disengaged from recess 56.

Figure 7B:
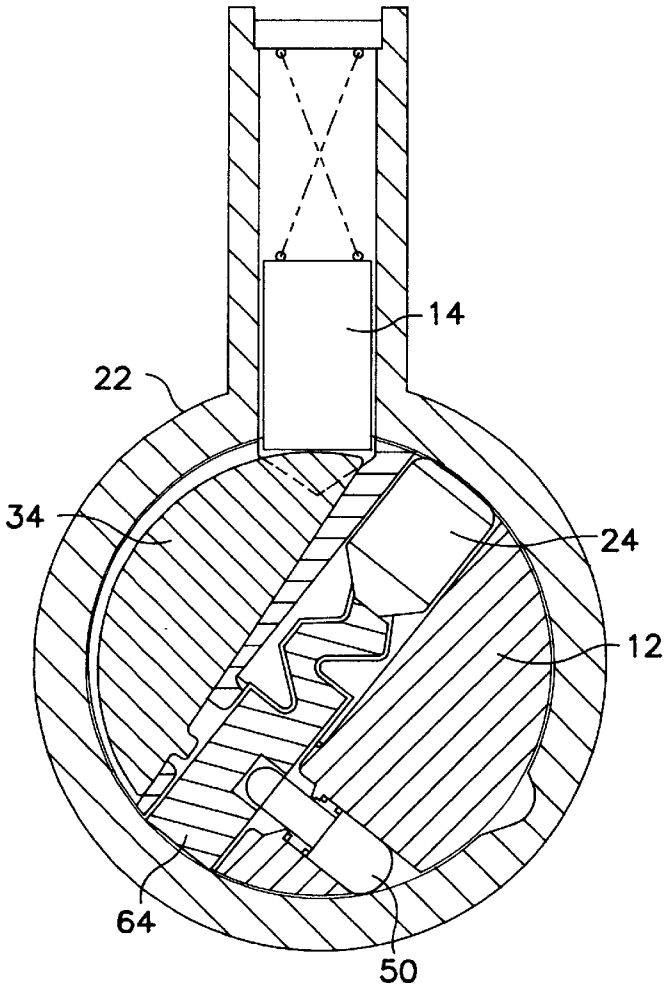
FIGS. 7*a* and 7*b* are views similar to FIG. 6 which represent the result of attempting to defeat a lock in accordance with the present invention through the use of a key having only the other of the key blade features of the invention.
Figure 7A:
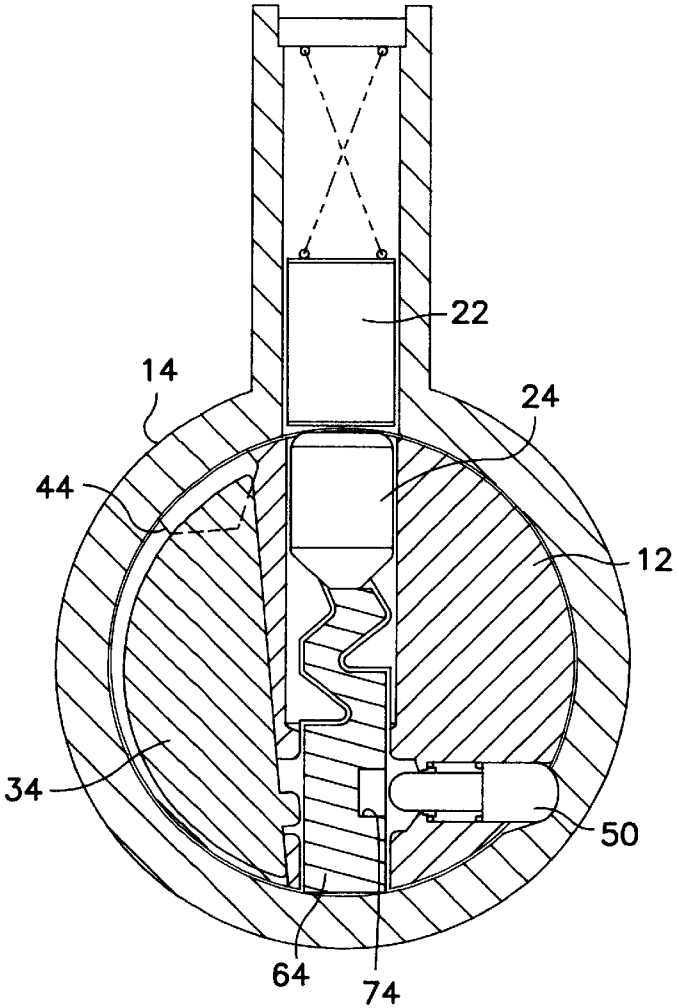

Referring to FIGS. 7A and 7B, insertion in keyway 28 of a key which satisfies the lock combination except for the camming projection 72 will permit rotation of core 12 within shell 14. As the core is rotated in the clockwise direction, it will carry the plate member 34. After a relatively small degree of rotation, as depicted in FIG. 7B, the plate member will "flop" over so that the side 36 thereof abuts the wall 30, this "flopping" action will result from either or both of interaction between spring biased driver pin 22 and plate 34 or the influence of gravity. When core rotation continues to the point where blind hole 44 is in registration with pin chamber 18, the driver pin 22 will, under the influence of spring 26, be driven into blind hole 44 until it bottoms on the top, i.e, the side 42, of plate member 34. At this point, because driver pin 22 will bridge the shear line, further rotation of the core in either a clockwise or counterclockwise direction will be prevented. Additionally, because of the interaction between the immobilized bottom pins and top edge of the key blade, the incorrect key will be trapped in the keyway, i.e., will not be removable. If the above-described trapping action is desired for both the clockwise and counterclockwise directions of rotation of core 12, a second plate member will be provided and a second projection will be formed on the side of the key blade which is oppositely disposed with respect to projection 72.

A lock in accordance with the invention may include a plurality of plates 34 and oppositely disposed auxiliary locking pins 50. The location of the plates and auxiliary locking pins may be reversed with respect to that shown and both relationships may be present in a single lock. Accordingly, as may be seen from FIG. 6, the shell 14 may expediently be provided with a pair of oppositely disposed longitudinal grooves which define recesses 56 and 56'.

As may be seen from FIG. 5B, where the lock is provided with plural plates 34 on the same side of the keyway, projections 72 will be formed with ramp surfaces on the leading surfaces on the leading and trailing edges. Likewise, as necessary (but not shown), indentations 74 will have ramps on both ends.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A cylinder lock comprising:

a shell, said shell having a plurality of pin tumbler receiving chambers, said shell further having an interior surface which defines a core receiving chamber having an axis, said pin tumbler receiving chambers extending to said interior surface, said shell being mounted with a fixed orientation in the use environment of said lock;

a rotatable core cooperating with said shell to form the relatively movable component of said lock, said core having an exterior surface and being disposed within said core receiving chamber of said shell for rotation about said chamber axis, said core defining a longitudinally extending keyway having oppositely disposed sides, said core having a plurality of pin tumbler receiving chambers, said core pin tumbler receiving chambers being alignable with said shell pin tumbler receiving chambers, said core pin tumbler receiving chambers extending between said keyway and said exterior surface of said core whereby communication may be established between said shell and core pin tumbler receiving chambers, a shear line for said lock being defined by the interface between said interior surface of said shell and said exterior surface of said core;

pin tumblers reciprocally disposed in said pin tumbler receiving chambers, said pin tumblers each having at least a bottom pin and a driver pin, said pins being in axial alignment and abutting contact, at least one of said pins of each of said pin tumblers extending across said shear line so as to be partly disposed in an aligned shell pin tumbler receiving chamber and core pin tumbler receiving chamber in the absence of a properly bitted key in said keyway, said pin tumblers each further including a first spring for resiliently biasing said aligned pins in the direction of said core;

at least first auxiliary locking means for establishing a rotation preventing mechanical coupling between said shell and said core in the absence in said keyway of a key having a first profile feature which cooperates with said first auxiliary locking means, said first auxiliary locking means being in part carried by and movable relative to said core, said first auxiliary locking means communicating with a first side of said keyway; and trapping means for mechanically capturing in said keyway keys which lack a second profile feature, said trapping means being carried by and being movable relative to said core, said trapping means extending between said shear line and a second side of said keyway, said keyway second side being oppositely disposed with respect to said keyway first side, said trapping means having an actuating portion which is at least in part in alignment with said auxiliary locking means, said actuating portion cooperating with a said second profile feature of a key, rotation of said core relative to said shell being permitted by key first profile feature induced movement of said first auxiliary locking means to decouple said core from said shell, rotation of said core to an unlocked orientation being permitted by key second profile feature induced movement of said trapping means to a non-trapping position.

2. The cylinder lock of claim 1 wherein said first auxiliary locking means comprises:

a locking pin receiving chamber in said core, said locking pin receiving chamber extending between said first side of said keyway and said core exterior surface, said locking pin receiving chamber having an axis;

a recess in said shell interior surface, said recess being in registration with said locking pin receiving chamber axis when said cylinder lock is in the locked state, said recess being at least in part defined by a wall shaped to define a cam surface, said cam surface merging with said shell interior surface;

a locking pin disposed in said core locking pin receiving chamber for reciprocal motion, said locking pin having a first end shaped to cooperate with said shell recess to establish said rotation preventing coupling, said locking pin first end at least in part defining a cam follower which cooperates with said shell recess defined cam surface whereby rotation of said core relative to said shell will impose a force in the direction of said keyway on said locking pin, said locking pin having a second end disposed oppositely with respect to said locking pin first end, said locking pin second end having a predetermined shape for cooperation with a shaped indentation in a key blade, said key blade shaped indentation defining said key first profile feature whereby rotation of said core relative to said shell with said key in said keyway will result in movement of said locking pin second end into said shaped key blade indentation and retraction of said locking pin first end from said shell recess; and a second spring for applying a resilient bias to said locking pin to urge said first end of said locking pin away from said keyway and towards said shell interior surface whereby said locking pin will normally extend across said shear line and into said shell recess.

3. The cylinder lock of claim 1 wherein said trapping means comprises:

a generally segment shaped cut-out in said core, said cut-out extending along an arcuate portion of said core exterior surface, said cut-out being at the longitudinal position of and offset from one of said core pin tumbler receiving chambers, said cut-out intercepting a lateral extension of said second side of said keyway; and a plate loosely fitting in said cut-out, said plate being movable relative to said core between a non-trapping first position wherein said plate causes said shear line to be substantially uninterrupted during rotation of said core relative to said shell and a trapping second position wherein at least a portion of said plate is displaced from the circumference of said core whereby a driver pin located in the shell pin tumbler chamber which cooperates with said one core pin tumbler chamber may move across said shear line, said trapping means actuating portion comprising a part of said plate which is in registration with said keyway lateral extension.

4. The cylinder lock of claim 3 wherein said first auxiliary locking means comprises:

a locking pin receiving chamber in said core, said locking pin receiving chamber extending between a first side of said keyway and said core exterior surface, said locking pin receiving chamber having an axis which is in registration with said keyway lateral extension;

a recess in said shell interior surface, said recess being in registration with said locking pin receiving chamber axis when said cylinder lock is in the locked state, said recess being at least in part defined by a wall shaped to define a cam surface, said cam surface merging with said shell interior surface;

a locking pin disposed in said core locking pin receiving chamber for reciprocal motion, said locking pin having a first end shaped to cooperate with said shell recess to establish said rotation preventing coupling, said locking pin first end at least in part defining a cam follower which cooperates with said shell recess defined cam surface whereby rotation of said core relative to said shell will impose a force in the direction of said keyway on said locking pin, said locking pin having a second end disposed oppositely with respect to said locking pin first end, said locking pin second end having a predetermined shape for cooperation with a shaped indentation in a key blade, said key blade shaped indentation defining said first key profile feature whereby rotation of said core relative to said shell with said key in said keyway will result in movement of said locking pin second end into said shaped key blade indentation and retraction of said locking pin first end from said shell recess; and a second spring for applying a resilient bias to said locking pin to urge said first end of said locking pin away from said keyway and towards said shell interior surface whereby said locking pin will normally extend across said shear line and into said shell recess.

5. The cylinder lock of claim 1 wherein said core defined keyway defines a plane and wherein said first auxiliary locking means is operable along an axis oriented generally transversely with respect to said plane, and wherein said trapping means actuating portion is disposed on said transverse axis.

6. The cylinder lock of claim 5 wherein said first auxiliary locking means includes an elongated locking pin having an axis and a first end which extends into said keyway in the unlocked state of said cylinder lock, wherein said trapping means actuating portion comprises a projection for cooperation with a camming projection on a key blade, and wherein said first end of said locking pin has a shape which will permit the reception thereof in a key blade indentation which is generally complementary in shape to said key blade camming projection.

7. The cylinder lock of claim 5 wherein said trapping means comprises:

a generally segment shaped cut-out in said core, said cut-out extending along an arcuate portion of said core exterior surface, said cut-out being at the longitudinal position of and offset from one of said core pin tumbler receiving chambers, said cut-out intercepting a lateral extension of said second side of said keyway, said keyway lateral extension at least in part lying on said transverse axis; and a plate loosely fitting in said cut-out, said plate being movable relative to said core between a non-trapping first position wherein said plate causes said shear line to be substantially uninterrupted during rotation of said core relative to said shell and a key trapping second position wherein at least a portion of said plate is displaced from the circumference of said core whereby a driver pin located in the shell pin tumbler chamber which cooperates with said one core pin tumbler chamber may move across said shear line, said trapping means actuating portion comprising a part of said plate which is in registration with said keyway lateral extension.

8. The cylinder lock of claim 5 wherein said first auxiliary locking means comprises:

a locking pin receiving chamber in said core, said locking pin receiving chamber extending between said first side of said keyway and said core exterior surface, said locking pin receiving chamber defining said transverse axis;

a recess in said shell interior surface, said recess being in registration with said locking pin receiving chamber axis when said cylinder lock is in the locked state, said recess being at least in part defined by a wall shaped to define a cam surface, said cam surface merging with said shell interior surface;

a locking pin disposed in said core locking pin receiving chamber for reciprocal motion, said locking pin having a first end shaped to cooperate with said shell recess to establish said rotation preventing coupling, said locking pin first end at least in part defining a cam follower which cooperates with said shell recess defined cam surface whereby rotation of said core relative to said shell will impose a force in the direction of said keyway on said locking pin, said locking pin having a second end disposed oppositely with respect to said locking pin first end, said locking pin second end having a predetermined shape for cooperation with a shaped indentation in a key blade, said key blade shaped indentation defining said key first profile feature whereby rotation of said core relative to said shell with said key in said keyway will result in movement of said locking pin second end into said shaped key blade indentation and retraction of said locking pin first end from said shell recess; and a second spring for applying a resilient bias to said locking pin to urge said first end of said locking pin away from said keyway and towards said shell interior surface whereby said auxiliary locking pin will normally extend across said shear line and into said shell recess.

9. The cylinder lock of claim 1 wherein said first auxiliary locking means comprises:

a locking pin receiving chamber in said core, said locking pin receiving chamber extending between said first side of said keyway and said core exterior surface;

a recess in said shell interior surface, said recess being in registration with said locking pin receiving chamber when said cylinder lock is in the locked state, said recess being at least in part defined by a wall shaped to define a cam surface, said cam surface merging with said shell interior surface;

a locking pin disposed in said core locking pin receiving chamber for reciprocal motion, said locking pin having a first end shaped to cooperate with said shell recess to establish said rotation preventing coupling, said locking pin first end at least in part defining a cam follower which cooperates with said shell recess defined cam surface whereby rotation of said core relative to said shell will impose a force in the direction of said keyway on said locking pin, said locking pin having a second end disposed oppositely with respect to said locking pin first end, said locking pin second end having a predetermined shape for cooperation with a shaped indentation in a key blade, said key blade shaped indentation defining said first profile feature whereby rotation of said core relative to said shell with said key in said keyway will result in movement of said locking pin second end into said shaped key blade indentation and retraction of said locking pin first end from said shell recess; and a second spring for applying a resilient bias to said locking pin to urge said first end of said locking pin away from said keyway and towards said shell interior surface whereby said auxiliary locking pin will normally extend across said shear line and into said shell recess.

10. A cylinder lock system comprising:

a shell having a plurality of pin tumbler receiving chambers, said shell further having an interior surface which defines a core receiving chamber, said pin tumbler receiving chambers extending to said interior surface, said shell being mounted with a fixed orientation in the use environment of said lock;

a core cooperating with said shell to form the relatively movable component of the lock of said system, said core being disposed within said core receiving chamber of said shell for rotation about an axis, said core defining a longitudinally extending keyway having oppositely disposed sides, said core further defining a plurality of pin tumbler receiving chambers, said core pin tumbler receiving chambers being alignable with said shell pin tumbler receiving chambers, said core pin tumbler receiving chambers extending between said keyway and an exterior surface of said core whereby communication may be established between said shell and core pin tumbler receiving chambers, a shear line for the lock of said system being defined by the interface between said interior surface of said shell and said exterior surface of said core;

pin tumblers reciprocally disposed in said pin tumbler receiving chambers, said pin tumblers each having at least a bottom pin and a driver pin which are in axial alignment and abutting contact, at least one of said pins of each of said pin tumblers extending across said shear line so as to be partly disposed in an aligned shell pin tumbler receiving chamber and core pin tumbler receiving chamber in the absence of a properly bitted key in said keyway, said pin tumblers each further including a first spring for resiliently biasing said aligned pins in the direction of said core;

at least first auxiliary locking means for establishing a rotation preventing mechanical coupling between said shell and said core in the absence in said keyway of a key having a first profile feature which cooperates with said first auxiliary locking means, said first auxiliary locking means being carried by and being movable relative to said core, said auxiliary locking means communicating with a first side of said keyway;

trapping means for mechanically capturing in said keyway keys which lack a second profile feature, said trapping means being carried by and being movable relative to said core, said trapping means extending between said shear line and a second side of said keyway which is oppositely disposed with respect to said first keyway side, said trapping means having an actuating portion which is at least in part in alignment with said first auxiliary locking means, said actuating portion of said trapping means cooperating with a said second profile feature of a key, rotation of said core relative to said shell being permitted by movement of said auxiliary locking means to decouple said core from said shell and rotation of said core to an unlocked orientation being permitted by key second profile feature induced movement of said trapping means to a non-trapping position; and a key, said key comprising:

a bow;

a blade longitudinally extending from said bow and terminating at a blade tip, said blade having first and second spacially displaced side faces and a pair of oppositely disposed and spaced edges which interconnect said side faces, said first and second side faces being at least in part substantially parallel to one another;

at least a first three dimensional projection extending outwardly from one of said blade side faces, said projection defining said second profile feature, the side of said projection which faces in the direction of said blade tip defining a ramp which extends to the maximum height of said projection whereby said projection can function as a cam in response to longitudinal movement of said blade; and an indentation in the second of said blade side faces, said indentation being in registration with said projection, said indentation defining said first profile feature.

11. The cylinder lock system of claim 10 wherein said keyway defines a plane and wherein said auxiliary locking means is operable along an axis oriented generally transversely with respect to said plane, and wherein said trapping means actuating portion is disposed on said transverse axis.

12. The cylinder lock system of claim 11 wherein said trapping means comprises:

a segment shaped cut-out in said core, said cut-out extending along an arcuate portion of said core exterior surface, said cut-out being at the longitudinal position of and offset from one of said core pin tumbler receiving chambers, said cut-out intercepting a lateral extension of said second side of said keyway; and a plate loosely fitting in said cut-out, said plate being movable relative to said core between a non-trapping first position wherein said plate causes said shear line to be substantially uninterrupted during rotation of said core relative to said shell and a key trapping second position wherein at least a portion of said plate is displaced from the circumference of said core whereby a driver pin located in the shell pin tumbler chamber which cooperates with said one core pin tumbler chamber may move across said shear line, said trapping means actuating portion comprising an extension of said plate which cooperate with said key blade projection.

13. The cylinder lock system of claim 12 wherein said auxiliary locking means comprises:

a locking pin receiving chamber in said core, said locking pin receiving chamber extending between a first side of said keyway and said core exterior surface;

a recess in said shell interior surface, said recess being in registration with said locking pin receiving chamber axis when said cylinder lock is in the locked state, said recess being at least in part defined by a wall shaped to define a cam surface, said cam surface merging with said shell interior surface;

a locking pin disposed in said core locking pin receiving chamber for reciprocal motion, said locking pin having a first end shaped to cooperate with said shell recess to establish said rotation preventing coupling, said locking pin first end at least in part defining a cam follower which cooperates with said shell recess defined cam surface whereby rotation of said core relative to said shell will impose a force in the direction of said keyway on said locking pin, said locking pin having a second end disposed oppositely with respect to said locking pin first end, said locking pin second end having a predetermined shape for cooperation with said key blade indentation whereby rotation of said core relative to said shell with said key in said keyway will result in movement of said locking pin second end into said key blade indentation and retraction of said locking pin first end from said shell recess; and a second spring for applying a resilient bias to said locking pin to urge said first end of said locking pin away from said keyway and towards said shell interior surface whereby said auxiliary locking pin will normally extend across said shear line and into said shell recess.

14. The cylinder lock system of claim 13 wherein said key blade indentation is generally complementary in shape to said key blade projection.

* * * * *